US007501026B2

(12) United States Patent
Riou

(10) Patent No.: US 7,501,026 B2
(45) Date of Patent: Mar. 10, 2009

(54) LIQUID HARD SURFACE CLEANING COMPOSITION

(75) Inventor: Fabienne Riou, Saint-Martin-des-Champs (FR)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/901,754

(22) Filed: Sep. 19, 2007

(65) Prior Publication Data

US 2008/0066788 A1 Mar. 20, 2008

(30) Foreign Application Priority Data

Sep. 19, 2006 (EP) ..... 06120909

(51) Int. Cl.
*B08B 3/04* (2006.01)

(52) U.S. Cl. ..... 134/34; 134/2; 134/25.2; 134/36; 134/41; 134/42; 510/108; 510/191; 510/238; 510/400; 510/475; 510/506

(58) Field of Classification Search ..... 134/2, 134/34, 36, 41, 42, 25.2; 510/108, 191, 238, 510/400, 475, 506
See application file for complete search history.

(56) References Cited

U.S. PATENT DOCUMENTS 5,707,952 A * 1/1998 Lambremont et al. ..... 510/362
5,916,967 A * 6/1999 Jones et al. ..... 524/732
6,083,422 A 7/2000 Ambuter et al.
6,096,349 A 8/2000 Petri et al.
6,342,474 B1 * 1/2002 Kerobo et al. ..... 510/405
6,498,137 B1 12/2002 Schalitz et al.
6,593,288 B2 * 7/2003 Aubay et al. ..... 510/504
2002/0193278 A1 * 12/2002 Cermenati et al. ..... 510/465
2003/0119689 A1 6/2003 Hutton et al.
2005/0170987 A1 * 8/2005 Scheibel et al. ..... 510/376
2005/0272622 A1 * 12/2005 Hariharan et al. ..... 510/267
2006/0135396 A1 * 6/2006 Schneiderman et al. ..... 510/424
2006/0234890 A1 * 10/2006 Griese et al. ..... 510/214
2008/0255018 A1 * 10/2008 Riou et al. ..... 510/238

FOREIGN PATENT DOCUMENTS

WO WO2004035726 A1 * 4/2004
WO WO2005093029 A1 * 10/2005

OTHER PUBLICATIONS

PCT International Search Report, Mailed Jul. 17, 2008, 5 Pages.

* cited by examiner

*Primary Examiner*—Sharidan Carrillo
(74) *Attorney, Agent, or Firm*—Amy I. Ahn-Roll

(57) ABSTRACT

The present invention relates to a process of cleaning a hard surface, said process comprising the step of applying a liquid hard surface cleaner composition onto said hard surface in the form of a spray, wherein said composition comprises a hydrophobically modified nonionic polyol.

11 Claims, No Drawings

LIQUID HARD SURFACE CLEANING COMPOSITION

TECHNICAL FIELD

The present invention relates to a process of cleaning a hard surface, said process comprising the step of applying a liquid hard surface cleaner composition onto said hard surface in the form of a spray, wherein said composition comprises a hydrophobically modified nonionic polyol. The liquid composition according to the present invention adheres well to the hard surface treated therewith.

BACKGROUND OF THE INVENTION

Liquid hard surface cleaning compositions are well known in the art. One subset of the known hard surface cleaning compositions are compositions applied onto a hard surface in the form of a spray.

It has been found that hard surface cleaning compositions applied onto a hard surface do not adhere sufficiently onto said hard surface. In particular, on more or less inclined hard surfaces, such as walls, shower cabins, bathtubs, toilet bowls and urinals, etc., hard surface cleaning compositions applied thereon have the tendency to run off in a short amount of time after the application thereon. Such a limited adherence significantly reduces the time of exposure of said composition onto the surface and linked thereto the cleaning performance.

It is thus an objective of the present invention to provide a hard surface cleaning composition that adheres for a prolonged period of time on a hard surface applied thereon, when applied in the form of a spray. Indeed it is an objective of the present invention to provide a spray-type hard surface cleaning composition that clings well to the surface applied.

It has been found that the above objective can be met by the process according to the present invention.

The compositions herein provide as an advantage an increased volume of foam when sprayed onto a hard surface and the droplets forming the foam are of a fine consistency. Indeed, the compositions herein provide a dense foam that clings well onto the hard surface sprayed upon.

It is an advantage of the compositions according to the present invention that they may be used to clean hard surfaces made of a variety of materials like glazed and non-glazed ceramic tiles, enamel, stainless steel, Inox®, Formica®, vinyl, no-wax vinyl, linoleum, melamine, glass, plastics.

A further advantage of the present invention is that the compositions herein are safe to consumers and not damaging to the treated surface, especially delicate surface such as linoleum, glass, plastic or chromed surfaces.

SUMMARY OF THE INVENTION

The present invention relates to a process of cleaning a hard surface, said process comprising the step of applying a liquid hard surface cleaner composition onto said hard surface in the form of a spray, wherein said composition comprises a hydrophobically modified nonionic polyol.

The present invention further encompasses the use of a hydrophobically modified nonionic polyol in a liquid hard surface cleaner composition applied onto a hard surface in the form of a spray, to provide a clinging foam on said hard surface.

DETAILED DESCRIPTION OF THE INVENTION

Surfaces to be Cleaned

The compositions according to the present invention are suitable to clean a hard surface. Any type of surface prone to soiling may be cleaned with the compositions herein. Preferably, the hard surfaces herein are hard-surfaces typically found in and around houses like bathrooms, kitchens, basements and garages, e.g., floors, walls, tiles, windows, sinks, showers, shower plastified curtains, wash basins, WCs, dishes, fixtures and fittings and the like made of different materials like ceramic, painted and un-painted concrete, varnished or sealed, plaster, bricks, vinyl, no-wax vinyl, linoleum, melamine, Formica®, glass, any plastics, metals, chromed surface and the like. The term hard surfaces as used herein also include household appliances including, but not limited to, washing machines, automatic dryers, refrigerators, freezers, ovens, microwave ovens, dishwashers and so on.

In a highly preferred embodiment the surfaces herein are hard-surfaces found in bathrooms, such as tiles, sinks, showers, wash basins, toilet bowls, urinals, bath tubs, fixtures and fittings and the like made of different materials like ceramic, enamel, glass, Inox®, Formica®, or metal and the like. Even more preferably, the hard surface herein is a bathtub, shower stall, toilet bowl and/or urinal.

In a highly preferred embodiment according to the present invention the hard surface herein is an at least partially inclined hard surface, preferably inclined hard surface. Indeed, the benefit of a improved adherence ("cling") is particularly observed when the hard surface cleaning compositions herein are sprayed onto inclined hard surfaces.

The Process of Cleaning a Hard Surface

The present invention encompasses a process of cleaning a hard surface, said process comprising the step of applying a liquid hard surface cleaner composition onto said hard surface in the form of a spray.

A preferred process of cleaning a hard surface comprises the step of applying a composition according to the present invention onto said hard surface in the form of a spray, leaving said composition on said hard surface to act, preferably for an effective amount of time, more preferably for a period comprised between 1 and 10 minutes, most preferably for a period comprised between 2 and 4 minutes; optionally wiping said hard surface with an appropriate instrument, e.g. a sponge; and then preferably rinsing said surface with water.

Preferably the composition of the present invention is applied onto the surface to be cleaned in its neat form. By "neat form" it is meant that the composition does not undergo a dilution step by the user immediately prior to the application onto said hard surface but is sprayed as supplied by the manufacturer.

The Liquid Hard Surface Cleaning Composition

The compositions according to the present invention are designed as hard surfaces cleaners.

The compositions according to the present invention are liquid compositions as opposed to a solid or a gas.

The liquid hard surface cleaning compositions according to the present invention are preferably aqueous compositions. Therefore, they may comprise from 70% to 99% by weight of the total composition of water, preferably from 75% to 95% and more preferably from 80% to 95%.

The compositions of the present invention are preferably acidic. Therefore, they typically have a pH of below 7, preferably 1-6.8, more preferably 3-6.5, even more preferably 3.5-6.5.

The compositions according to the present invention may optionall comprise an acid and/or an alkaline material.

Preferred acids herein are organic or inorganic acids or mixtures thereof, these acids may be added on top of the organic acids and slats thereof as described herein below. Preferred organic acids are acetic acid, lactic acid or citric acid or a mixture thereof. Preferred inorganic acids are sulfuric acid or phosphoric acid or a mixture thereof.

A typical level of such an acid, when present, is of from 0.01% to 15%, preferably from 1% to 10% and more preferably from 2% to 7% by weight of the total composition.

The alkaline material to be used herein to adjust the pH can be organic or inorganic bases. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate and hydrogen carbonate.

Typical levels of alkaline material, when present, are of from 0.1% to 5% by weight, preferably from 0.3% to 2% and more preferably from 0.5% to 1.5% by weight of the composition.

Preferably, the liquid hard surface cleaning compositions herein have a viscosity of up to 5000 cps at 20 $s^{-1}$, more preferably from 5000 cps to 50 cps, yet more preferably from 2000 cps to 50 cps and most preferably from 1200 cps to 50 cps at 20 $s^{-1}$ and 20° C. when measured with a Rheometer, model AR 1000 (Supplied by TA Instruments) with a 4 cm conic spindle in stainless steel, 2° angle (linear increment from 0.1 to 100 $sec^{-1}$ in max. 8 minutes).

In another preferred embodiment according to the present invention the compositions herein are thickened compositions. Thus, the liquid hard surface cleaning compositions herein preferably have a viscosity of from 50 cps to 5000 cps at 20 $s^{-1}$, more preferably from 50 cps to 2000 cps, yet more preferably from 50 cps to 1000 cps and most preferably from 50 cps to 500 cps at 20 $s^{-1}$ and 20° C. when measured with a Rheometer, model AR 1000 (Supplied by TA Instruments) with a 4 cm conic spindle in stainless steal, 2° angle (linear increment from 0.1 to 100 $sec^{-1}$ in max. 8 minutes).

Hydrophobically Modified Nonionic Polyol

The compositions herein comprise a hydrophobically modified nonionic polyol as an essential ingredient.

The compositions herein preferably comprise from 0.0001% to 5%, preferably from 0.001% to 4%, more preferably from 0.01% to 3%, even more preferably from 0.1% to 2% and most preferably from 0.5% to 1.5% by weight of the total composition of said hydrophobically modified nonionic polyol.

It has been surprisingly found that hard surface cleaning compositions comprising a hydrophobically modified nonionic polyol when sprayed onto a hard surface form a foam that adheres well on the surface treated therewith. This adherence or cling is substantially improved over hard surface cleaning compositions that are free of hydrophobically modified nonionic polyols. The cling is particularly beneficial in the case where the hard surface to be cleaned is an at least partially inclined hard surface. The excellent adherence results in a prolonged period of time said hard surface cleaning compositions remains on the hard surface to which it is applied (sprayed). Furthermore, it has been surprisingly found that that hard surface cleaning compositions comprising a hydrophobically modified nonionic polyol when sprayed onto a hard surface form provide an increased volume of foam and the droplets forming the foam are of a finer consistency. Indeed, the compositions herein provide a dense foam that clings well onto the hard surface sprayed upon.

In a preferred embodiment according to the present invention, the hydrophobically modified nonionic polyol herein have a molecular weight of 60000-150000, preferably 70000 to 120000, more preferably 80000 to 100000.

Preferred hydrophobically modified nonionic polyols are hydrophobically modified polyurethanes and more preferably modified ethoxylated urethanes.

Suitable hydrophobically modified nonionic polyols are obtained by condensation polymerisation.

Suitable hydrophobically modified nonionic polyols are commercially available under the tradenames Acusol 882® from Rohm and Haas.

Optional Ingredients

The compositions according to the present invention may comprise a variety of optional ingredients depending on the technical benefit aimed for and the surface treated.

Suitable optional ingredients for use herein include chelating agents, nonionic surfactants, vinylpyrrolidone homopolymer or copolymer, polysaccharide polymer, radical scavengers, perfumes, surface-modifying polymers other than vinylpyrrolidone homo- or copolymers and polysaccharide polymers, solvents, other surfactants, builders, buffers, bactericides, hydrotropes, colorants, stabilizers, bleaches, bleach activators, suds controlling agents like fatty acids, silicone polymer, enzymes, soil suspenders, brighteners, anti dusting agents, dispersants, pigments, and dyes.

Chelating Agent

The compositions of the present invention may comprise a chelating agent or mixtures thereof, as a highly preferred optional ingredient. Chelating agents can be incorporated in the compositions herein in amounts ranging from 0% to 10% by weight of the total composition, preferably 0.01% to 5.0%, more preferably 0.05% to 1%.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities.

Preferred chelating agents to be used herein are diethylene triamine penta methylene phosphonate (DTPMP) and ethane 1-hydroxy diphosphonate (HEDP). In a particularly preferred execution of the present invention, the chelating agent is selected to be ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraamine-hexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Nonionic Surfactant

The compositions of the present invention may preferably comprise a nonionic surfactant, or a mixture thereof. This class of surfactants may be desired as it further contributes to cleaning performance of the hard surface cleaning compositions herein. It has been found in particular that nonionic surfactants strongly contribute in achieving highly improved performance on greasy soap scum removal (a soil often found on bathroom hard surfaces).

The compositions according to the present invention may comprise up to 15% by weight of the total composition of a nonionic surfactant or a mixture thereof, preferably from 0.1% to 15%, more preferably from 1% to 10%, even more preferably from 1% to 5%, and most preferably from 1% to 3%.

Suitable nonionic surfactants for use herein are alkoxylated alcohol nonionic surfactants, which can be readily made by condensation processes which are well-known in the art. However, a great variety of such alkoxylated alcohols, especially ethoxylated and/or propoxylated alcohols, is conveniently commercially available. Surfactants catalogs are available which list a number of surfactants, including nonionics.

Accordingly, preferred alkoxylated alcohols for use herein are nonionic surfactants according to the formula RO(E)e(P)pH where R is a hydrocarbon chain of from 2 to 24 carbon atoms, E is ethylene oxide and P is propylene oxide, and e and p which represent the average degree of, respectively ethoxylation and propoxylation, are of from 0 to 24 (with the sum of e+p being at least 1). Preferably, the hydrophobic moiety of the nonionic compound can be a primary or secondary, straight or branched alcohol having from 8 to 24 carbon atoms.

Preferred nonionic surfactants for use in the compositions according to the invention are the condensation products of ethylene oxide and/or propylene oxide with alcohols having a straight or branched alkyl chain, having from 6 to 22 carbon atoms, wherein the degree of alkoxylation (ethoxylation and/or propoxylation) is from 1 to 15, preferably from 5 to 12. Such suitable nonionic surfactants are commercially available from Shell, for instance, under the trade name Neodol® or from BASF under the trade name Lutensol®.

Additional Surfactant

The compositions of the present invention may comprise an additional surfactant, or mixtures thereof, on top of the nonionic surfactant already described herein. Additional surfactants may be desired herein as they further contribute to the cleaning performance and/or shine benefit of the compositions of the present invention. Surfactants to be used herein include anionic surfactants, cationic surfactants, amphoteric surfactants, zwitterionic surfactants, and mixtures thereof.

Accordingly, the compositions according to the present invention may comprise up to 15% by weight of the total composition of another surfactant or a mixture thereof, on top of the anionic surfactant already described herein, more preferably from 0.5% to 5%, even more preferably from 0.5% to 3%, and most preferably from 0.5% to 2%. Different surfactants may be used in the present invention including anionic, cationic, zwitterionic or amphoteric surfactants. It is also possible to use mixtures of such surfactants without departing from the spirit of the present invention.

Preferred surfactants for use herein are anionic and zwitterionic surfactants since they provide excellent grease soap scum cleaning ability to the compositions of the present invention.

Anionic surfactants may be included herein as they contribute to the cleaning benefits of the hard-surface cleaning compositions of the present invention. Indeed, the presence of an anionic surfactant contributes to the greasy soap scum cleaning of the compositions herein. More generally, the presence of an anionic surfactant in the liquid compositions according to the present invention allows to lower the surface tension and to improve the wettability of the surfaces being treated with the liquid compositions of the present invention. Furthermore, the anionic surfactant, or a mixture thereof, helps to solubilize the soils in the compositions of the present invention.

Suitable anionic surfactants for use herein are all those commonly known by those skilled in the art. Preferably, the anionic surfactants for use herein include alkyl sulphonates, alkyl aryl sulphonates, or mixtures thereof.

Particularly suitable linear alkyl sulphonates include C8 sulphonate like Witconate® NAS 8 commercially available from Witco.

Other anionic surfactants useful herein include salts (including, for example, sodium, potassium, ammonium, and substituted ammonium salts such as mono-, di- and triethanolamine salts) of soap, alkyl sulphates, alkyl aryl sulphates alkyl alkoxylated sulphates, C8-C24 olefinsulfonates, sulphonated polycarboxylic acids prepared by sulphonation of the pyrolyzed product of alkaline earth metal citrates, e.g., as described in British patent specification No. 1,082,179; alkyl ester sulfonates such as C14-16 methyl ester sulfonates; acyl glycerol sulfonates, alkyl phosphates, isethionates such as the acyl isethionates, N-acyl taurates, alkyl succinamates, acyl sarcosinates, sulfates of alkylpolysaccharides such as the sulfates of alkylpolyglucoside (the nonionic nonsulfated compounds being described below), alkyl polyethoxy carboxylates such as those of the formula RO(CH2CH2O)kCH2COO-M+ wherein R is a C8-C22 alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Suitable zwitterionic surfactants for use herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used.

Some common examples of zwitterionic surfactants (i.e. betaine/sulphobetaine) are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N,N-dimethyl-ammonia) acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

A further example of betaine is Lauryl-immino-dipropionate commercially available from Rhodia under the trade name Mirataine H2C-HA®.

Particularly preferred zwitterionic surfactants for use in the compositions of the present invention are the sulfobetaine surfactants as they deliver optimum soap scum cleaning benefits.

Examples of particularly suitable sulfobetaine surfactants include tallow bis(hydroxyethyl) sulphobetaine, cocoamido propyl hydroxy sulphobetaines which are commercially available from Rhodia and Witco, under the trade name of Mirataine CBS® and Rewoteric AM CAS 15® respectively.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference. Additional synthetic detergents and listings of their commercial sources can be found in McCutcheon's Detergents and Emulsifiers, North American Ed. 1980, incorporated herein by reference.

Suitable amphoteric surfactants include the amine oxides. Examples of amine oxides for use herein are for instance coconut dimethyl amine oxides, C12-C16 dimethyl amine oxides. Said amine oxides may be commercially available from Clariant, Stepan, and AKZO (under the trade name Aromox®). Other suitable amphoteric surfactants for the purpose of the invention are the phosphine or sulfoxide surfactants.

Cationic surfactants suitable for use in compositions of the present invention are those having a long-chain hydrocarbyl group. Examples of such cationic surfactants include the quaternary ammonium surfactants such as alkyldimethylammonium halogenides. Other cationic surfactants useful herein are also described in U.S. Pat. No. 4,228,044, Cambre, issued Oct. 14, 1980, incorporated herein by reference.

Radical Scavenger

The compositions of the present invention may further comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers, when used, may be typically present herein in amounts up to 10% by weight of the total composition and preferably from 0.001% to 0.5% by weight. The presence of radical scavengers may contribute to the chemical stability of the compositions of the present invention.

Perfume

Suitable perfume compounds and compositions for use herein are for example those described in EP-A-0 957 156 under the paragraph entitled "Perfume", on page 13. The compositions herein may comprise a perfume ingredient, or mixtures thereof, in amounts up to 5.0% by weight of the total composition, preferably in amounts of 0.1% to 1.5%.

Solvent

The compositions of the present invention may further comprise a solvent or a mixture thereof, as an optional ingredient. Solvents to be used herein include all those known to those skilled in the art of hard-surfaces cleaner compositions. In a highly preferred embodiment, the compositions herein comprise an alkoxylated glycol ether (such as n-Butoxy Propoxy Propanol (n-BPP)) or a mixture thereof.

Typically, the compositions of the present invention may comprise from 0.1% to 5% by weight of the total composition of a solvent or mixtures thereof, preferably from 0.5% to 5% by weight of the total composition and more preferably from 1% to 3% by weight of the total composition.

Dye

The liquid compositions according to the present invention may be coloured. Accordingly, they may comprise a dye or a mixture thereof.

Bleach

The compositions according to the present invention may comprise, as an optional ingredient, a bleach. Preferably, said bleach is selected from the group consisting of sources of active oxygen, hypohalite bleaches and mixtures thereof.

The bleach, preferably the source of active oxygen according to the present invention acts as an oxidising agent, it increases the ability of the compositions to remove colored stains and organic stains in general, to destroy malodorous molecules and to kill germs.

In a preferred embodiment according to the present invention said bleach is a source of active oxygen or a mixture thereof.

Suitable sources of active oxygen for use herein are water-soluble sources of hydrogen peroxide including persulfate, dipersulphate, persulfuric acid, percarbonates, metal peroxides, perborates, persilicate salts, and mixtures thereof, as well as hydrogen peroxide, and mixtures thereof. As used herein a hydrogen peroxide source refers to any compound that produces hydrogen peroxide when said compound is in contact with water In addition, other classes of peroxides can be used as an alternative to hydrogen peroxide and sources thereof or in combination with hydrogen peroxide and sources thereof. Suitable classes include dialkylperoxides, diacylperoxides, preformed percarboxylic acids, organic and inorganic peroxides and/or hydroperoxides.

Suitable organic or inorganic peracids for use herein are selected from the group consisting of: persulphates such as monopersulfate; peroxyacids such as diperoxydodecandioic acid (DPDA) and phthaloyl amino peroxycaproic acid (PAP); magnesium perphthalic acid; perlauric acid; perbenzoic and alkylperbenzoic acids; and mixtures thereof.

Suitable hydroperoxides for use herein are selected from the group consisting of tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage to be particularly safe to carpets and carpet dyes while delivering excellent bleaching performance.

Persulfate salts, or mixtures thereof, are the preferred sources of active oxygen to be used in the compositions according to the present invention. Preferred persulfate salt to be used herein is the monopersulfate triple salt. One example of monopersulfate salt commercially available is potassium monopersulfate commercialized by Peroxide Chemie GMBH under the trade name Curox®. Other persulfate salts such as dipersulphate salts commercially available from Peroxide Chemie GMBH can be used in the compositions according to the present invention.

The compositions according to. the present invention may comprise from 0.1% to 30%, preferably from 0.1% to 20%, more preferably from 1% to 10%, and most preferably from 1% to 7% by weight of the total composition of said bleach.

Silicone Polymer

The liquid composition according to the present invention may further comprise a silicone polymer as an optional but highly preferred ingredient.

Silicon polymers are preferred optional ingredients herein as they deposit onto the surfaces cleaned with a composition according to the present invention. Thereby, soil adherence, limescale and/or mineral encrustation build-up, is prevented. Indeed, it has been found, that the optional silicone polymers herein, deposit onto the hard surface, which is thereby rendered less prone the adherence and/or the build-up of limescale and mineral encrustation, etc. ("mineral deposition").

The composition herein may comprise up to 50%, more preferably of from 0.01% to 30%, even more preferably of from 0.01% to 20%, and most preferably of from 0.01% to 10%, by weight of the total composition of said silicone polymer.

Suitable silicone polymers are selected from the group consisting of silicone glycol polymers and mixtures thereof.

In a preferred embodiment according to the present invention, the silicone polymer herein is a silicone glycol polymer.

Depending on the relative position of the silicone-polyether chains, the silicone glycol polymer can be either linear or grafted.

Preferably, said silicone glycol polymer is according to the following formulae:

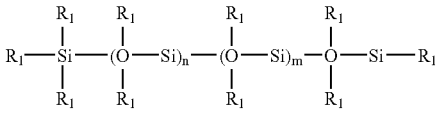

Grafted structure

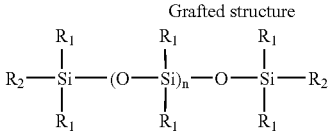

Linear structure wherein: each $R_1$ independently is H or a hydrocarbon radical; $R_2$ is a group bearing a polyether functional group; n is an integer of from 0 to 500; and for the grafted structure m is an integer of from 1 to 300, and preferably with n+m more than 1.

In a highly preferred embodiment herein the silicone polymer herein is a grafted silicone glycol.

Preferably, each $R_1$ independently is H or a hydrocarbon chain comprising from 1 to 16, more preferably a hydrocarbon chain comprising from 1 to 12 carbon atoms, and even more preferably $R_1$ is a $CH_3$-group. $R_1$ can also contain $NH_2$ groups and/or quaternary ammoniums.

Preferably, n is an integer of from 0 to 100, more preferably an integer of from 1 to 100, even more preferably n is an integer of from 1 to 50, and most preferably n is an integer of from 5 to 30.

Preferably, m (for the grafted structure) is an integer of from 1 to 80, more preferably m is an integer of from 1 to 30, and even more preferably m is an integer of from 2 to 10. Preferably, n+m is more than 2.

Preferably, $R_2$ is an alkoxylated hydrocarbon chain. More preferably, $R_2$ is according to the general formulae:

$$—R_3\text{-}(A)_p\text{-}R_4 \text{ or } \text{-}(A)_p\text{-}R_4$$

wherein: $R_3$ is a hydrocarbon chain; A is an alkoxy group or a mixture thereof; p is an integer of from 1 to 50; and $R_4$ is H or a hydrocarbon chain, or —COOH.

Preferably, $R_3$ is a hydrocarbon chain comprising from 1 to 12, more preferably 3 to 10, even more preferably from 3 to 6, and most preferably 3 carbon atoms.

Preferably, A is an ethoxy or propoxy or butoxy unit or a mixture thereof, more preferably A is an ethoxy group.

Preferably, p is an integer of from 1 to 50, more preferably p is an integer of from 1 to 30, and even more preferably p is an integer of from 5 to 20.

Preferably, $R_4$ is H or a hydrocarbon chain comprising from 1 to 12, more preferably 1 to 6, even more preferably from 3 to 6, and still even preferably 3 carbon atoms, most preferably $R_4$ is H.

Preferably, the silicone glycol polymers suitable herein have an average molecular weight of from 500 to 100,000, preferably from 600 to 50,000, more preferably from 1000 to 40,000, and most preferably from 2,000 to 20,000.

Suitable, silicone glycol polymers are commercially available from General electric, Dow Corning, and Witco (see Applicant's co-pending European Patent Applications 03 447 099.7 and 03 447 098.9 for an extensive list of trade names of silicone glycol polymers).

In a highly preferred embodiment according to the present invention, the polymer herein is a Silicones-Polyethers copolymer, commercially available under the trade name SF 1288® from GE Bayer Silicones.

Packaging

The compositions suitable for use in the process according to the present invention are applied onto the hard surface in the form of a spray, preferably in the form of a spray of droplets. Indeed, the compositions herein are sprayed onto the hard surfaces to be treated.

Any container suitable for application of a liquid composition in the form of a spray onto a hard surface may be chosen to package the liquid compositions herein.

In a preferred embodiment herein, the liquid hard surface cleaning composition herein is packed in a spray-type dispenser, preferably a manually operated trigger spray-type dispenser.

Such spray dispensers may be manually or electrically operated. Typical manually operated spray dispensers include pump operated ones or trigger operated ones. Indeed, in such a container with a spray dispenser head the composition contained in the container is directed through the spray dispenser head via energy communicated to a pumping mechanism by the user as said user activates said pumping mechanism or to an electrically driven pump. Spray-type dispensers, and in particular manually operated trigger spray-type dispenser, are commercially available from Guala (Trigger Sprayers TS1, 2 or 3-series), AFA Polytek, Continental AFA and other Spray-type dispensers supplier.

EXAMPLES

These following compositions were made comprising the listed ingredients in the listed proportions (weight %). The examples herein are met to exemplify the present invention but are not necessarily used to limit or otherwise define the scope of the present invention.

| | Examples | | | | | |
|---|---|---|---|---|---|---|
| | I | II | III | IV | V | VI |
| Neodol 91-8 ® | — | 3.0 | 2.5 | 3.5 | — | — |
| HLAS | — | — | 1.0 | — | — | — |
| C12-14 AO | — | — | 1.0 | — | 1.5 | — |
| n-BPP | — | — | 2.0 | 2.5 | — | 2.8 |
| H2O2 | — | 3.0 | — | — | 3.5 | — |
| Acusol 882 ® | 1.0 | 1.5 | 1.0 | 0.8 | 1.2 | 1.0 |
| Lactic acid | — | 3.0 | — | 3.5 | 4.0 | 3.0 |
| Citric acid | 1.0 | — | 3.0 | 0.5 | 0.5 | — |
| Water | | | up to 100% | | | |

Compositions I-VI have an acidic pH
Lactic acid is commercially available from Purac.
Citric acid is commercially available from ADM.
Neodol 91-8 ® is a $C_9$-$C_{11}$ EO8 nonionic surfactant, commercially available from SHELL.
n-BPP is n-butoxy propoxy propanol.
Acusol 882 ® is a hydrophobically modified nonionic polyol (hydrophobically modified ethoxylated polyurethane) commercially available from Rohm and Hass.
H2O2 is hydrogen peroxide
C12-14 AO is a C12-14 dimethyl amine oxide surfactant.
HLAS is an alkyl benzene sulphonate surfactant.

Example compositions I-VI are packed in a manually operated trigger sprayer (Guala TS-3 model) and sprayed onto a partially inclined hard surface. The compositions exhibit excellent adherence on said hard surface and provide a dense foam.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the, citation of any document is not to be construed as an admission that it is prior art with respect to the present invention.

While particular embodiments of the present invention have been illustrated and described, it would be obvious to those skilled in the art that various other changes and modifications can be made without departing from. the spirit and scope of the invention. It is therefore intended to cover in the appended claims all such changes and modifications that are within the scope of this invention.

What is claimed is:

1. A process of cleaning a hard surface, said process comprising the step of applying an acidic liquid hard surface cleaner composition having a pH of 3-6.5 onto said hard surface in the form of a spray, wherein said composition comprises from about 0.0001% to about 5% by weight of the total composition of a hydrophobically modified ethoxylated polyurethane and wherein said composition further comprises silicone glycol polymers and n-butoxy propoxy propanol.

2. A process according to claim 1 wherein said hydrophobically modified ethoxylated polyurethane has a molecular weight of about 60000 to about 150000.

3. A process according to claim 1 wherein said composition comprises from about 0.5% to about 1.5% by weight of the total composition of said hydrophobically modified ethoxiylated polyurethane.

4. A process according to claim 1 wherein said composition has a pH of about 3.5 to about 6.5.

5. A process according to claim 1 wherein said composition additionally comprises a bleach.

6. A process according to claim 1 wherein said composition additionally comprises a chelant.

7. A process according to claim 1 wherein said hard surface is located in a bathroom, in a toilet or in a kitchen.

8. A process according to claim 1 wherein said hard surface is a bathtub, shower stall, toilet bowl and/or urinal.

9. A process according to claim 1 wherein said hard surface is an at least partially inclined hard surface.

10. A process according to claim 1 wherein said composition is packed in a spray-type dispenser.

11. A process according to claim 6 wherein said chelant is selected from the group consisting of alkali metal ethane 1 -hydroxy diphosphonates, alkylene poly (alkylene phosphonate), amino aminotri (methylene phosphonic acid), nitrilo trimethylene phosphonates, ethylene diamine tetra methylene phosphonates, and diethylene triamine penta methylene phosphonates, and mixtures thereof.

* * * * *

UNITED STATES PATENT AND TRADEMARK OFFICE

CERTIFICATE OF CORRECTION

PATENT NO. : 7,501,026 B2
APPLICATION NO. : 11/901754
DATED : March 10, 2009
INVENTOR(S) : Fabienne Riou It is certified that error appears in the above-identified patent and that said Letters Patent is hereby corrected as shown below:

Column 9

Line 17, delete "to." and insert -- to --.

Lines 49-59, delete

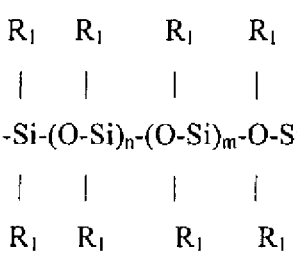

" $R_1$-Si-(O-Si)$_n$-(O-Si)$_m$-O-Si-$R_1$ Grafted structure "

and insert

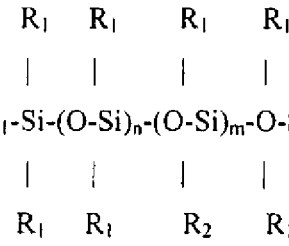

-- $R_1$-Si-(O-Si)$_n$-(O-Si)$_m$-O-Si-$R_1$ Grafted structure --.

Column 11

Line 34, delete "Hass." and insert -- Haas. --.

Column 12

Line 1, delete "the," and insert -- the --.

Line 7, delete "from." and insert -- from --.

UNITED STATES PATENT AND TRADEMARK OFFICE

CERTIFICATE OF CORRECTION

PATENT NO. : 7,501,026 B2
APPLICATION NO. : 11/901754
DATED : March 10, 2009
INVENTOR(S) : Fabienne Riou It is certified that error appears in the above-identified patent and that said Letters Patent is hereby corrected as shown below:

Claim 3
Lines 3-4, delete "ethoxiylated" and insert -- ethoxylated --.

Signed and Sealed this

Twenty-ninth Day of September, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,501,026 B2
APPLICATION NO. : 11/901754
DATED : March 10, 2009
INVENTOR(S) : Fabienne Riou It is certified that error appears in the above-identified patent and that said Letters Patent is hereby corrected as shown below:

Column 9

Line 17, delete "to." and insert -- to --.

Lines 49-59, delete

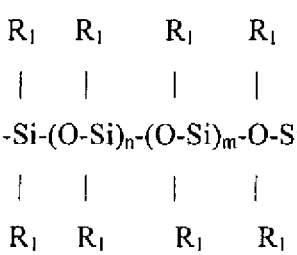

" $R_1$-Si-(O-Si)$_n$-(O-Si)$_m$-O-Si-$R_1$ Grafted structure "

and insert

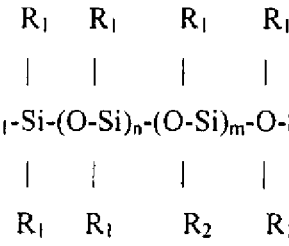

-- $R_1$-Si-(O-Si)$_n$-(O-Si)$_m$-O-Si-$R_1$ Grafted structure --.

Column 11

Line 34, delete "Hass." and insert -- Haas. --.

Column 12

Line 1, delete "the," and insert -- the --.

Line 7, delete "from." and insert -- from --.

UNITED STATES PATENT AND TRADEMARK OFFICE

CERTIFICATE OF CORRECTION

PATENT NO. : 7,501,026 B2
APPLICATION NO. : 11/901754
DATED : March 10, 2009
INVENTOR(S) : Fabienne Riou It is certified that error appears in the above-identified patent and that said Letters Patent is hereby corrected as shown below:

Column 12, Claim 3
Lines 27-28, delete "ethoxiylated" and insert -- ethoxylated --.

This certificate supersedes the Certificate of Correction issued September 29, 2009.

Signed and Sealed this

Twenty-seventh Day of October, 2009

David J. Kappos

David J. Kappos
*Director of the United States Patent and Trademark Office*